US007450143B2

(12) United States Patent
Lee

(10) Patent No.: US 7,450,143 B2
(45) Date of Patent: Nov. 11, 2008

(54) ELECTRO-PHOTOGRAPHIC IMAGE FORMING DEVICE CAPABLE OF CONTROLLING PRINT SPEED AND CONTROL METHOD THEREOF

(75) Inventor: Chang-bok Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 224 days.

(21) Appl. No.: 11/180,588

(22) Filed: Jul. 14, 2005

(65) Prior Publication Data

US 2006/0017798 A1 Jan. 26, 2006

(30) Foreign Application Priority Data

Jul. 22, 2004 (KR) ..... 10-2004-0057146

(51) Int. Cl.
*B41J 2/47* (2006.01)

(52) U.S. Cl. ..... 347/247; 347/237

(58) Field of Classification Search ..... 347/111, 347/112, 129, 130, 233, 237, 247
See application file for complete search history.

(56) References Cited

U.S. PATENT DOCUMENTS 5,030,994 A * 7/1991 Roman et al. ..... 399/138
6,693,723 B2 * 2/2004 Keithley et al. ..... 358/1.2

FOREIGN PATENT DOCUMENTS

JP 03-180868 8/1991
JP 03180868 A * 8/1991
JP 2001-282052 10/2001
JP 2002-333807 11/2002
JP 2003-280488 10/2003

OTHER PUBLICATIONS

Masaaki Nakano, et al., Image Recording Device [Translation of JP 03-180868 A].*

* cited by examiner

*Primary Examiner*—Huan H Tran
(74) *Attorney, Agent, or Firm*—Roylance, Abrams, Berdo & Goodman, LLP

(57) ABSTRACT

An electro-photographic image forming device that is capable of controlling a print speed and a method for controlling the same, wherein the electro-photographic image forming device has an engine mechanism including a laser scanning unit, a developing unit, a transfer roller, and a fixing unit. The electro-photographic image forming device further includes a first driving unit for driving the laser scanning unit, a second driving unit for driving the photosensitive medium, the developing unit, the transfer roller, and the fixing unit, and a controller for controlling the first and second driving units so as to have the laser scanning unit driven at a first driving speed and to have the photosensitive medium, the developing unit, the transfer roller, and the fixing unit, driven at a second driving speed in the engine mechanism when it is determined that a print mode for printing desired print data is set to a draft mode.

10 Claims, 3 Drawing Sheets

ELECTRO-PHOTOGRAPHIC IMAGE FORMING DEVICE CAPABLE OF CONTROLLING PRINT SPEED AND CONTROL METHOD THEREOF

CROSS-REFERENCE TO RELATED APPLICATIONS

This application claims benefit under 35 U.S.C. §119(a) of Korean Patent Application No. 10-2004-0057146, filed in the Korean Intellectual Property Office on Jul. 22, 2004, the entire disclosure of which is incorporated herein by reference.

BACKGROUND OF THE INVENTION

1. Field of the Invention

The present invention relates to an electro-photographic image forming device. More particularly, the present invention relates to an electro-photographic image forming device that is capable of controlling a print speed and a method for controlling the same.

2. Description of the Related Art

Examples of an image forming device employing an electro-photographic scheme may include a copy machine, a laser beam printer (LBP), a light emitting diode (LED) printer, a plain paper facsimile, and so forth.

The electro-photographic image forming device performs a print operation for printing a predetermined image on a record sheet through a series of photo-transfer processes consisting of electrification, exposure, development, transfer, fixing, and delivery. Hereinafter, an LBP will be used as an example for providing a description of such conventional devices.

A print engine of the LBP is comprised of an engine driving system for driving a photosensitive drum, a developing unit, a fixing unit or the like, and a laser scanning unit (LSU) driving system for driving the LSU. A print speed of the LBP is determined by the performance of the engine driving system and the LSU driving system. A driving speed of the LSU driving system is determined by a driving speed of the engine driving system. That is, the print speed of the LBP is determined by a diameter of the photosensitive drum, a development processing speed of the developing unit, a number of polygon mirror planes, a rotating speed of a polygon motor for driving the polygon mirror, and so forth.

As such, in order to enhance the print speed in a state wherein the performance of each component is already determined, the driving speed of the engine driving system or the driving speed of the LSU driving system should be increased. However, there is some difficulty in enhancing the performance due to a limit of the performance already given for each driving system. In particular, it is difficult to increase the rotating speed of the polygon motor which is already rotating at a fast speed. Thus, the driving speed of the LSU driving system is a major factor limiting the enhancement of the print speed of the LBP. For example, in the case wherein the LBP is capable of printing 20 pages per minute, the rotating speed of the polygon motor supports up to 20 pages per minute, so that printing more than 20 pages per minute cannot be performed. As such, in the conventional LBP, the print operation cannot be performed at a print speed greater than the print speed that the print engine can support.

Accordingly, a need exists for a printing system and method such that a print operation can be performed at a print speed greater than the print speed that the print engine can support.

SUMMARY OF THE INVENTION

It is therefore an object of the present invention to substantially solve the above and other problems, and provide an electro-photographic image forming device that is capable of controlling the print speed so as to enhance the print speed without increasing a speed of a laser scanning unit, and a method for controlling the same.

According to one aspect of the present invention, an electro-photographic image forming device is provided which has an engine mechanism comprising a laser scanning unit for scanning lights onto a photosensitive medium, a developing unit for developing an electrostatic latent image formed on the photosensitive medium by the laser scanning unit with a developer, a transfer roller for transferring the developed image to a record sheet being fed, and a fixing unit for fusing the image transferred on the record sheet by applying heat and pressure on the image. The electro-photographic image forming device comprises a first driving unit for driving the laser scanning unit, and a second driving unit for driving the photosensitive medium, the developing unit, the transfer roller, and the fixing unit. The electro-photographic image forming device further comprises a controller for controlling the first and second driving units so as to have the laser scanning unit driven at a first driving speed and to have the photosensitive medium, the developing unit, the transfer roller, and the fixing unit, driven at a second driving speed in the engine mechanism when it is determined that a print mode for printing desired print data is set to a draft mode.

The controller is further provided to remove a portion of image data corresponding to a sub scanning direction of the laser scanning unit using a bitmap omission method when it is determined that the print mode is the draft mode.

In this case, the first driving speed is a reference driving speed applied in a normal print mode, and the second driving speed is faster than the first driving speed.

The controller is still further provided to drive the engine mechanism at the first driving speed when the print mode is a normal print mode.

According to another aspect of the present invention, a method is provided for controlling an electro-photographic image forming device which is capable of controlling a print speed and having an engine mechanism, the engine mechanism comprising a laser scanning unit for scanning lights onto a photosensitive medium, a developing unit for developing an electrostatic latent image formed on the photosensitive medium by the laser scanning unit with a developer, a transfer roller for transferring the developed image to a record sheet being fed, and a fixing unit for fusing the image transferred on the record sheet by applying heat and pressure on the image. The method comprises the steps of determining whether a print mode for printing print data is a draft mode when the print data is received from an external apparatus, and performing a print operation on the print data by having the laser scanning unit driven at a first driving speed and having the photosensitive medium, the developing unit, the transfer roller, and the fixing unit driven at a second driving speed when it is determined that the print mode is the draft mode.

Preferably, the method further comprises the step of removing a portion of print data corresponding to a sub scanning direction of the laser scanning unit using a bitmap omission method to convert a format of the print data, wherein the print operation is carried out for the format-converted print data.

The first driving speed is a reference driving speed applied in a normal print mode, and the second driving speed is faster than the first driving speed.

BRIEF DESCRIPTION OF THE DRAWINGS

The above aspects and features of the present invention will become more apparent by describing certain embodiments of the present invention with reference to the accompanying drawings, in which.

Throughout the drawings, like reference numerals will be understood to refer to like parts, components and structures.

DETAILED DESCRIPTION OF THE EXEMPLARY EMBODIMENTS

Hereinafter, the present invention will be described in detail with reference to the accompanying drawings.

Figure 1:
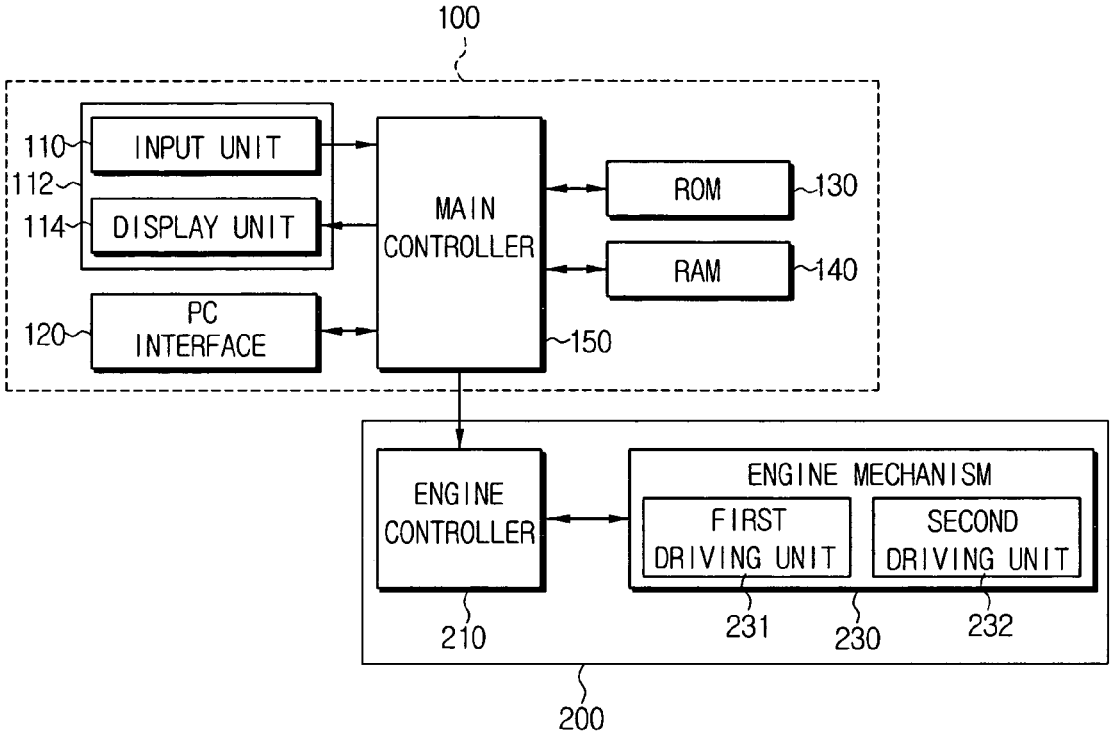
FIG. 1 is a block view of a laser beam printer (LBP) in accordance with an exemplary embodiment of the present invention.

FIG. 1 is a block view of an image forming device employing an electro-photographic scheme, specifically, a laser beam printer (LBP), in accordance with an exemplary embodiment of the present invention. The LBP is presented as one example, and the present invention is not limited thereto.

Referring to FIG. 1, the LBP of an exemplary embodiment of the present invention is essentially comprised of a video controller 100 and a print engine 200. The video controller 100 is comprised of an image processing means for converting print data transmitted from a device, such as a host computer (not shown) as an external apparatus, into image data in a bitmap format which may be recognized by the print engine 200. The print engine 200 is comprised of a print means for printing the image data provided from the video controller 100 onto a record sheet.

The video controller 100 of an exemplary embodiment of the present invention comprises an operating panel 112, a personal computer (PC) interface 120, a read only memory (ROM) 130, a random access memory (RAM) 140, and a main controller 150. The print engine 200 comprises an engine controller 210 and an engine mechanism 230.

The operating panel 112 comprises an input unit 110 and a display unit 114.

The input unit 110 comprises a plurality of function keys that are capable of selecting and setting functions supported by the LBP, and applies a key input signal provided by the key operation to the main controller 150. A print mode selection key (not shown) that is capable of controlling the print speed of the print engine 200, is also provided in the input unit 110 of an exemplary embodiment of the present invention. The print engine 200 of an exemplary embodiment of the present invention performs a normal print mode or a draft mode in response to the selected print mode.

The display unit 114 displays the operating states of the LBP under the control of the main controller 150.

The PC interface 120 is disposed so as to enable communication with the host computer as the external apparatus, and receives print option information (for example, print range, number of print pages, print mode, and so forth), and print data transmitted from the host computer. The print mode of the print engine 200 of an exemplary embodiment of the present invention may be set using the mode selection key provided in the input unit 110 of the operating panel 112, or a user interface (UI) provided from a printer driver installed in the host computer.

The ROM 130 stores various application programs and control programs for driving the main controller 150.

The RAM 140 temporarily stores various data generated during a program operation of the main controller 150, and prints data applied from the host computer through the PC interface 120.

The main controller 150 controls the general operations of the LBP based on the control programs stored in the ROM 130. For example, the main controller 150 is provided to determine a driving condition for each component included in the engine mechanism 230 in response to the print mode set by a user, and control the engine controller 210 so as to have the printing operation performed in response to the determined driving condition. That is, the print speed of the print engine 200 is determined by the driving condition, namely, the driving speed, of each component included in the engine mechanism 230.

In addition, the main controller 150 is provided to convert a format of desired image data to be printed in response to the set print mode. For example, when the print resolution which may be supported by the print engine 200 is 600 dpi (dots per inch), and the print speed of the print engine 200 is 10 ppm (pages per minute) in a normal print mode, the main controller 150 converts the format of the image data to a data format of 600 (main scanning)×600 (sub scanning), and applies the converted data to the engine controller 210.

Alternatively, when the print speed of the print engine 200 is increased to 20 ppm in a draft mode, the main controller 150 converts the format of the image data to a data format of 600×300, and applies the converted data to the engine controller 210. This is because a horizontal scanning speed of the laser scanning unit in the engine mechanism 230 is kept at its initially set speed, and the driving speed of the remaining components (that is, the photosensitive drum, developing unit, transfer roller, and so forth) is increased to be greater than the initially set driving speed, to thereby increase the print speed. As such, a portion of the image data corresponding to the sub scanning direction is removed using a bitmap omission method in accordance with an exemplary embodiment of the present invention, so that the vertical data may be prevented from being extended.

As noted above, the print engine 200 is comprised of the engine controller 210 and the engine mechanism 230.

The engine controller 210 is provided to control the driving of the engine mechanism 230 under the control of the main controller 150.

The engine mechanism 230 is comprised of a mechanical device for performing the printing operation under the control of the engine controller 210, and comprises a first driving unit 231 for driving the laser scanning unit (hereinafter, referred to as LSU), and a second driving unit 232 for driving the photosensitive drum, the electrification unit, the developing unit, the transfer unit, the fixing unit, and so forth.

Figure 2:
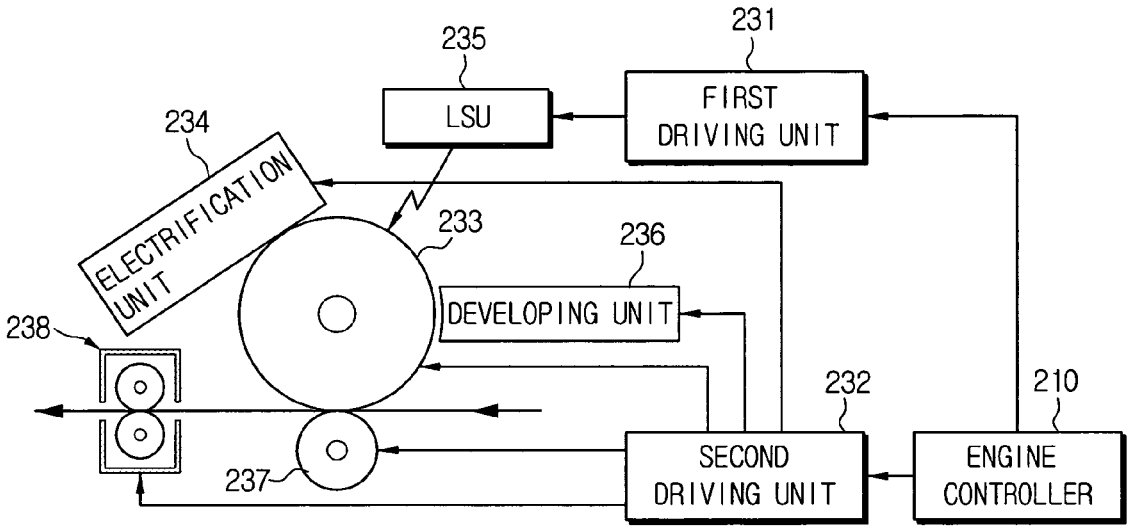
FIG. 2 is a schematic cross-sectional view of the print engine shown in FIG. 1.

FIG. 2 is a schematic cross-sectional view of the print engine 200 shown in FIG. 1.

Referring to FIGS. 1 and 2, the engine mechanism 230 further comprises a photosensitive drum 233 applied with a photosensitive medium, an electrification unit 234 for charging the photosensitive drum 233 with a predetermined potential, an LSU 235 for scanning a laser beam corresponding to the image data onto the photosensitive drum 233 charged by the electrification unit 234, a developing unit 236 for supplying a developer to the photosensitive drum 233 on which an electrostatic latent image is formed and developing the image, a transfer roller 237 being engaged and rotated with the photosensitive drum 233 to transfer the developed image on the photosensitive drum 233 onto a record sheet, and a fixing unit 238 for fusing the transferred image on the record sheet by applying heat and pressure on the sheet.

The first driving unit 231 drives the LSU 235 under the control of the engine controller 210. That is, the first driving unit 231 controls the point of time for the scanning of a laser beam diode provided in the LSU 235, the rotation number of a polygon mirror (not shown), and so forth, under the control of the engine controller 210. The LSU 235 of an exemplary embodiment of the present invention is driven at a constant speed regardless of the set print mode.

The second driving unit 232 drives the photosensitive drum 233, the electrification unit 234, the developing unit 236, the transfer roller 237, and the fixing unit 238, under the control of the engine controller 210. The photosensitive drum 233, the electrification unit 234, the developing unit 236, the transfer roller 237, and the fixing unit 238, are driven at a different speed in response to the set print mode. For example, the photosensitive drum 233, the electrification unit 234, the developing unit 236, the transfer roller 237, and the fixing unit 238, are each driven at the first driving speed which is initially set, when the set print mode is the normal print mode, and are driven at the second driving speed which is faster than the first driving speed, when the set print mode is the draft mode.

Figure 3:
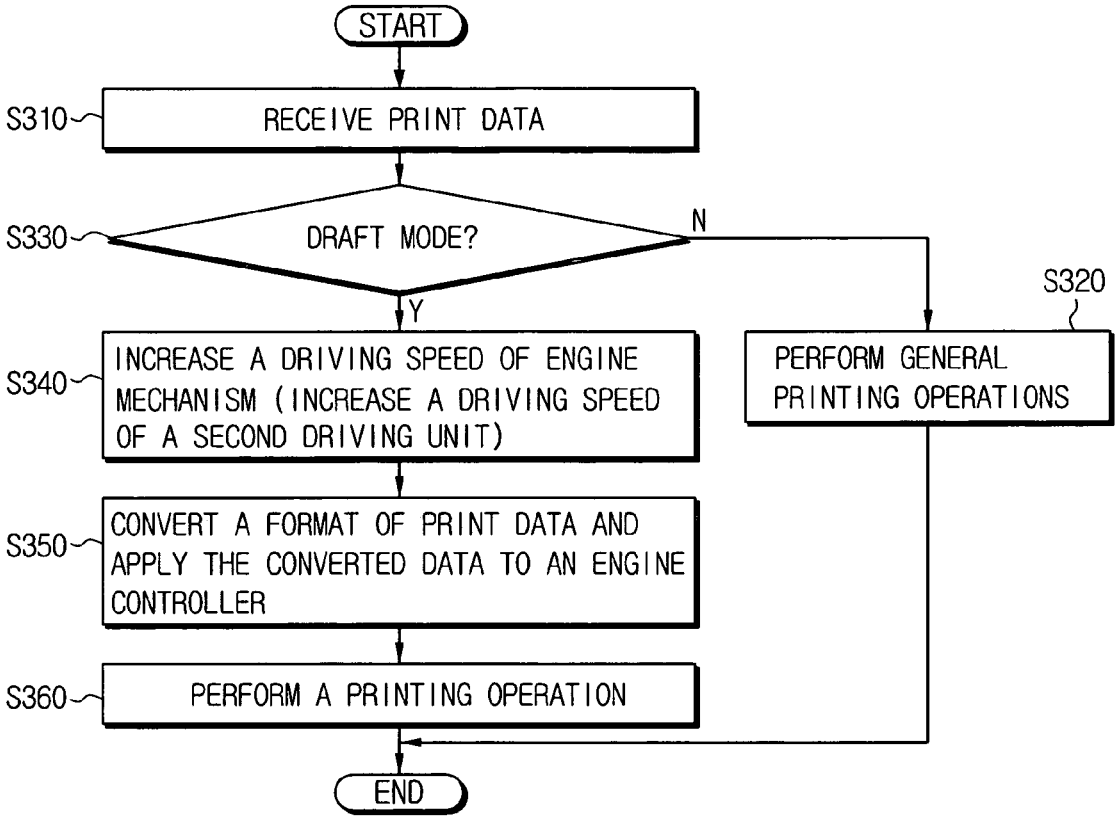
FIG. 3 is a flow chart for illustrating a method for controlling printing of the LBP shown in FIG. 1 in accordance with an exemplary embodiment of the present invention.

FIG. 3 is a flow chart for illustrating a method for controlling printing of the LBP shown in FIG. 1 in accordance with an exemplary embodiment of the present invention.

Referring to FIGS. 1 to 3, when the print data is received from the host computer through the PC interface 120 at step S310, the main controller 150 determines whether the print mode set for printing the print data is the draft mode or the normal print mode at step S330.

When it is determined that the set print mode is the normal print mode at step S330, the main controller 150 has a general printing operation performed at step S320. That is, the main controller 150 controls the engine controller 210 so as to have the printing operation performed at the first driving speed that is initially set (for example, 10 ppm). Accordingly, the LSU 235, the photosensitive drum 233, the electrification unit 234, the developing unit 236, the transfer roller 237, and the fixing unit 238, are all driven at the first driving speed which is initially set.

Alternatively, when it is determined that the set print mode is the draft mode at step S330, the main controller 150 controls the engine controller 210 so as to increase the driving speed of the second driving unit 232 for driving the photosensitive drum 233, the electrification unit 234, the developing unit 236, the transfer roller 237, and the fixing unit 238. That is, at step S340, the main controller 150 has the driving speed of the first driving unit 231 maintained at the first driving speed which is initially set, and has the driving speed of the second driving unit 232 increased to the second driving speed (for example, 20 ppm) which is faster than the first driving speed (10 ppm). Accordingly, the LSU 235 is driven at the first driving speed which is initially set, and the photosensitive drum 233, the electrification unit 234, the developing unit 236, the transfer roller 237, and the fixing unit 238, are each driven at the second driving speed.

The main controller 150 then converts the format of the received print data to a format suitable for the draft mode, and transmits the format-converted print data and a print control instruction to the engine controller 210 at step S350. According to an exemplary embodiment of the present invention, the horizontal scanning speed of the LSU 235 in the draft mode is maintained, and the driving speed of the remaining components is increased, so that the main controller 150 converts the data format such that a portion of the vertical data among the print data is removed.

The engine controller 210 then controls the engine mechanism 230 to have the engine mechanism perform the printing operation on the print data in response to the print control instruction provided from the main controller 150 at step S360. The engine mechanism 230 performs the printing operation on the print data under control of the engine controller 210.

According to exemplary embodiments of the present invention as described above, the print speed of the electro-photographic image forming device may be controlled. That is, the print speed may be increased without increasing the driving speed of the LSU, which has been a major factor limiting the speed increase, so that the performance of the electro-photographic image forming device may be enhanced.

The foregoing embodiments and advantages are merely exemplary, and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. An electro-photographic image forming device that is capable of controlling a print speed and having an engine mechanism, the engine mechanism comprising a laser scanning unit for scanning lights onto a photosensitive medium, a developing unit for developing an electrostatic latent image formed on the photosensitive medium by the laser scanning unit with a developer, a transfer roller for transferring the developed image to a record sheet being fed, and a fixing unit for fusing the image transferred on the record sheet by applying heat and pressure on the image, the electro-photographic image forming device comprising:

a first driving unit, for driving the laser scanning unit;

a second driving unit, for driving at least one of the photosensitive medium, the developing unit, the transfer roller, and the fixing unit; and a controller, for controlling the first and second driving units so as to have the laser scanning unit driven at a first driving speed, and to have at least one of the photosensitive medium, the developing unit, the transfer roller, and the fixing unit driven at a second driving speed in the engine mechanism, and remove a portion of print data corresponding to a sub scanning direction only, when it is determined that a print mode for printing desired print data is set to a draft mode.

2. The electro-photographic image forming device as recited in claim 1, wherein:

the controller is programmable to remove the portion of print data corresponding to the sub scanning direction of the laser scanning unit using a bitmap omission method when it is determined that the print mode is the draft mode.

3. The electro-photographic image forming device as recited in claim 1, wherein the first driving speed is a reference driving speed applied in a normal print mode, and the second driving speed is faster than the first driving speed.

4. The electro-photographic image forming device as recited in claim 3, wherein:

the controller is programmable to drive the engine mechanism at the first driving speed when the print mode is the normal print mode.

5. A method of controlling an electro-photographic image forming device that is capable of controlling a print speed and having an engine mechanism, the engine mechanism comprising a laser scanning unit for scanning lights onto a photosensitive medium, a developing unit for developing an electrostatic latent image formed on the photosensitive medium by the laser scanning unit with a developer, a transfer roller for transferring the developed image to a record sheet being fed, and a fixing unit for fusing the image transferred on the record sheet by applying heat and pressure on the image, the method comprising the steps of:

determining whether a print mode for printing print data is a draft mode; and performing a print operation on the print data by having the laser scanning unit driven at a first driving speed, and having at least one of the photosensitive medium, the developing unit, the transfer roller, and the fixing unit, driven at a second driving speed, and remove a portion of print data corresponding to a sub scanning direction only, when it is determined that the print mode is the draft mode.

6. The method as recited in claim 5, further comprising the steps of:

removing the portion of image data corresponding to the sub scanning direction of the laser scanning unit using a bitmap omission method to convert a format of the image data; and performing the print operation for the format-converted print data.

7. The method as recited in claim 5, wherein the first driving speed is a reference driving speed applied in a normal print mode, and the second driving speed is faster than the first driving speed.

8. The method as recited in claim 5, wherein the step of determining whether a print mode for printing print data is a draft mode is performed when the print data is received from an external apparatus.

9. A method of controlling an electro-photographic image forming device that is capable of controlling a print speed, the device comprising a laser scanning unit, a photosensitive drum, an electrification unit, a developing unit, a transfer roller, and a fixing unit, the method comprising the steps of:

determining whether a print mode set for printing print data is a draft mode or a normal print mode when the print data is received from a host;

performing a general printing operation when it is determined that the set print mode is the normal print mode, wherein the general printing operation is performed at a first driving speed that is initially set such that at least one of the laser scanning unit, the photosensitive drum, the electrification unit, the developing unit, the transfer roller, and the fixing unit, are driven at the first driving speed;

performing a draft printing operation when it is determined that the set print mode is the draft print mode, wherein the driving speed of the laser scanning unit is maintained at the first driving speed and the driving speed of the at least one of the photosensitive drum, the electrification unit, the developing unit, the transfer roller, and the fixing unit is increased to a second driving speed which is faster than the first driving speed, and removing a portion of print data corresponding to a sub scanning direction only; and performing a printing operation on the print data.

10. The method as recited in claim 9, further comprising the steps of:

removing the portion of image data corresponding to the sub scanning direction of the laser scanning unit using a bitmap omission method to convert a format of the print data; and performing the print operation for the format-converted print data.

* * * * *